US006863194B2

(12) United States Patent
Kweon et al.

(10) Patent No.: US 6,863,194 B2
(45) Date of Patent: Mar. 8, 2005

(54) LIQUID CRYSTAL DISPENSING APPARATUS HAVING INTEGRATED NEEDLE SHEET

(75) Inventors: Hyug-Jin Kweon, Kyoungsangbuk-Do (KR); Hae-Joon Son, Pusan (KR)

(73) Assignee: LG.Philips LCD Co., Ltd., Seoul (KR)

( * ) Notice: Subject to any disclaimer, the term of this patent is extended or adjusted under 35 U.S.C. 154(b) by 237 days.

(21) Appl. No.: 10/329,444

(22) Filed: Dec. 27, 2002

(65) Prior Publication Data

US 2003/0155383 A1 Aug. 21, 2003

(30) Foreign Application Priority Data

Feb. 20, 2002 (KR) ..... 10-2002-0009124

(51) Int. Cl.[7] ..... B65D 83/000

(52) U.S. Cl. ..... 222/400.5; 222/504; 366/273; 427/256

(58) Field of Search ..... 222/386.5, 389, 222/394, 399, 400.5, 504, 501, 630; 366/273; 427/256

(56) References Cited

U.S. PATENT DOCUMENTS

| | | | |
|---|---|---|---|
| 3,978,580 | A | 9/1976 | Leupp et al. |
| 4,094,058 | A | 6/1978 | Yasutake et al. |
| 4,653,864 | A | 3/1987 | Baron et al. |
| 4,691,995 | A | 9/1987 | Yamazaki et al. |
| 4,775,225 | A | 10/1988 | Tsuboyama et al. |
| 5,247,377 | A | 9/1993 | Omeis et al. |
| 5,263,888 | A | 11/1993 | Ishihara et al. |
| 5,379,139 | A | 1/1995 | Sato et al. |
| 5,406,989 | A | 4/1995 | Abe |
| 5,499,128 | A | 3/1996 | Hasegawa et al. |
| 5,507,323 | A | 4/1996 | Abe |
| 5,511,591 | A | 4/1996 | Abe |
| 5,539,545 | A | 7/1996 | Shimizu et al. |
| 5,548,429 | A | 8/1996 | Tsujita |
| 5,642,214 | A | 6/1997 | Ishii et al. |
| 5,680,189 | A | 10/1997 | Shimizu et al. |
| 5,742,370 | A | 4/1998 | Kim et al. |
| 5,757,451 | A | 5/1998 | Miyazaki et al. |
| 5,852,484 | A | 12/1998 | Inoue et al. |
| 5,854,664 | A | 12/1998 | Inoue et al. |
| 5,861,932 | A | 1/1999 | Inata et al. |
| 5,875,922 | A | 3/1999 | Chastine et al. |
| 5,952,676 | A | 9/1999 | Sato et al. |
| 5,956,112 | A | 9/1999 | Fujimori et al. |
| 6,001,203 | A | 12/1999 | Yamada et al. |
| 6,011,609 | A | 1/2000 | Kato et al. |
| 6,016,178 | A | 1/2000 | Kataoka et al. |
| 6,016,181 | A | 1/2000 | Shimada |
| 6,055,035 | A | 4/2000 | von Gutfeld et al. |

(List continued on next page.)

FOREIGN PATENT DOCUMENTS

| | | |
|---|---|---|
| EP | 1 003 066 A1 A1 | 5/2000 |
| JP | 51-065656 | 6/1976 |
| JP | 57-038414 A1 | 3/1982 |
| JP | 57-088428 A1 | 6/1982 |
| JP | 58-027126 A1 | 2/1983 |

(List continued on next page.)

*Primary Examiner*—Gene Mancene
*Assistant Examiner*—Melvin Cartagena
(74) *Attorney, Agent, or Firm*—McKenna Long & Aldridge LLP

(57) ABSTRACT

A liquid crystal dispensing apparatus includes a needle sheet formed as a unitary piece for dispensing liquid crystal material contained within a liquid crystal container through a nozzle by selectively contacting a needle. The needle sheet includes a needle contacting portion for contacting the needle and a coupling portion for coupling the liquid crystal container to the nozzle. Therefore liquid crystal material is prevented from remaining within the needle sheet and the needle sheet can be easily cleaned.

8 Claims, 6 Drawing Sheets

U.S. PATENT DOCUMENTS

| | | | |
|---|---|---|---|
| 6,163,357 | A | 12/2000 | Nakamura |
| 6,219,126 | B1 | 4/2001 | von Gutfeld |
| 6,226,067 | B1 | 5/2001 | Nishiguchi et al. |
| 6,236,445 | B1 | 5/2001 | Foschaar et al. |
| 6,304,306 | B1 | 10/2001 | Shiomi et al. |
| 6,304,311 | B1 | 10/2001 | Egami et al. |
| 6,337,730 | B1 | 1/2002 | Ozaki et al. |
| 6,414,733 | B1 | 7/2002 | Ishikawa et al. |
| 2001/0021000 | A1 | 9/2001 | Egami |

FOREIGN PATENT DOCUMENTS

| | | | |
|---|---|---|---|
| JP | 59-057221 | | 4/1984 |
| JP | 59-195222 | | 11/1984 |
| JP | 60-111221 | | 6/1985 |
| JP | 60-164723 | A1 | 8/1985 |
| JP | 60-217343 | A1 | 10/1985 |
| JP | 61-007822 | A1 | 1/1986 |
| JP | 61-055625 | A1 | 3/1986 |
| JP | 62-089025 | A1 | 4/1987 |
| JP | 62-090622 | A1 | 4/1987 |
| JP | 62-205319 | A1 | 9/1987 |
| JP | 63-109413 | A1 | 5/1988 |
| JP | 63-110425 | A1 | 5/1988 |
| JP | 63-128315 | A1 | 5/1988 |
| JP | 63-311233 | A1 | 12/1988 |
| JP | 05-127179 | A1 | 5/1993 |
| JP | 05-154923 | | 6/1993 |
| JP | 05-265011 | A1 | 10/1993 |
| JP | 05-281557 | A1 | 10/1993 |
| JP | 05-281562 | A1 | 10/1993 |
| JP | 06-051256 | A1 | 2/1994 |
| JP | 06-148657 | A1 | 5/1994 |
| JP | 06-160871 | | 6/1994 |
| JP | 06-235925 | | 8/1994 |
| JP | 06-265915 | A1 | 9/1994 |
| JP | 06-313870 | | 11/1994 |
| JP | 07-084268 | | 3/1995 |
| JP | 07-128674 | A1 | 5/1995 |
| JP | 07-181507 | A1 | 7/1995 |
| JP | 08-095066 | A1 | 4/1996 |
| JP | 08-101395 | | 4/1996 |
| JP | 08-106101 | A1 | 4/1996 |
| JP | 08-171094 | A1 | 7/1996 |
| JP | 08-190099 | A1 | 7/1996 |
| JP | 08-240807 | A1 | 9/1996 |
| JP | 09-005762 | A1 | 1/1997 |
| JP | 09-026578 | A1 | 1/1997 |
| JP | 09-061829 | | 3/1997 |
| JP | 09-073075 | A1 | 3/1997 |
| JP | 09-073096 | A1 | 3/1997 |
| JP | 09-127528 | A1 | 5/1997 |
| JP | 09-230357 | A1 | 9/1997 |
| JP | 09-281511 | A1 | 10/1997 |
| JP | 09-311340 | A1 | 12/1997 |
| JP | 10-123537 | A1 | 5/1998 |
| JP | 10-123538 | A1 | 5/1998 |
| JP | 10-142616 | A1 | 5/1998 |
| JP | 10-177178 | | 6/1998 |
| JP | 10-221700 | A1 | 8/1998 |
| JP | 10-282512 | A1 | 10/1998 |
| JP | 10-333157 | | 12/1998 |
| JP | 10-333159 | | 12/1998 |
| JP | 11-014953 | A1 | 1/1999 |
| JP | 11-038424 | A1 | 2/1999 |
| JP | 11-064811 | A1 | 3/1999 |
| JP | 11-109388 | A1 | 4/1999 |
| JP | 11-133438 | | 5/1999 |
| JP | 11-142864 | | 5/1999 |
| JP | 11-174477 | A1 | 7/1999 |
| JP | 11-212045 | A1 | 8/1999 |
| JP | 11-248930 | | 9/1999 |
| JP | 11-326922 | | 11/1999 |
| JP | 11-344714 | A1 | 12/1999 |
| JP | 2000-002879 | | 1/2000 |
| JP | 2000-029035 | | 1/2000 |
| JP | 2000-056311 | | 2/2000 |
| JP | 2000-066165 | | 3/2000 |
| JP | 2000-137235 | | 5/2000 |
| JP | 2000-147528 | | 5/2000 |
| JP | 2000-193988 | | 7/2000 |
| JP | 2000-241824 | | 9/2000 |
| JP | 2000-284295 | | 10/2000 |
| JP | 2000-292799 | | 10/2000 |
| JP | 2000-310759 | | 11/2000 |
| JP | 2000-310784 | | 11/2000 |
| JP | 2000-338501 | | 12/2000 |
| JP | 2001-005401 | | 1/2001 |
| JP | 2001-005405 | | 1/2001 |
| JP | 2001-013506 | | 1/2001 |
| JP | 2001-033793 | A1 | 2/2001 |
| JP | 2001-042341 | | 2/2001 |
| JP | 2001-051284 | | 2/2001 |
| JP | 2001-066615 | | 3/2001 |
| JP | 2001-091727 | | 4/2001 |
| JP | 2001-117105 | | 4/2001 |
| JP | 2001-117109 | | 4/2001 |
| JP | 2001-133745 | | 5/2001 |
| JP | 2001-133794 | | 5/2001 |
| JP | 2001-133799 | | 5/2001 |
| JP | 2001-142074 | | 5/2001 |
| JP | 2001-147437 | | 5/2001 |
| JP | 2001-154211 | | 6/2001 |
| JP | 2001-166272 | | 6/2001 |
| JP | 2001-166310 | | 6/2001 |
| JP | 2001-183683 | | 7/2001 |
| JP | 2001-209052 | | 8/2001 |
| JP | 2001-209060 | | 8/2001 |
| JP | 2001-222017 | | 8/2001 |
| JP | 2001-235758 | | 8/2001 |
| JP | 2001-215459 | | 9/2001 |
| JP | 2001-255542 | | 9/2001 |
| JP | 2001-264782 | | 9/2001 |
| JP | 2001-201750 | | 10/2001 |
| JP | 2001-272640 | | 10/2001 |
| JP | 2001-281675 | | 10/2001 |
| JP | 2001-281678 | | 10/2001 |
| JP | 2001-282126 | | 10/2001 |
| JP | 2001-305563 | | 10/2001 |
| JP | 2001-330837 | | 11/2001 |
| JP | 2001-330840 | A1 | 11/2001 |
| JP | 2001-356353 | | 12/2001 |
| JP | 2001-356354 | A1 | 12/2001 |
| JP | 2002-014360 | A1 | 1/2002 |
| JP | 2002-023176 | A1 | 1/2002 |
| JP | 2002-049045 | A1 | 2/2002 |
| JP | 2002-082340 | A1 | 3/2002 |
| JP | 2002-090759 | A1 | 3/2002 |
| JP | 2002-090760 | A1 | 3/2002 |
| JP | 2002-107740 | A1 | 4/2002 |
| JP | 2002-122872 | A1 | 4/2002 |
| JP | 2002-122873 | A1 | 4/2002 |
| JP | 2002-139734 | | 5/2002 |
| JP | 2002-202512 | A1 | 7/2002 |
| JP | 2002-202514 | A1 | 7/2002 |
| JP | 2002-214626 | A1 | 7/2002 |
| KR | 2000-035302 | A1 | 6/2000 |

LIQUID CRYSTAL DISPENSING APPARATUS HAVING INTEGRATED NEEDLE SHEET

This application incorporates by reference two co-pending applications, Ser. No. 10/184,096, filed on Jun. 28, 2002, entitled "SYSTEM AND METHOD FOR MANUFACTURING LIQUID CRYSTAL DISPLAY DEVICES" and Ser. No. 10/184,088, filed on Jun. 28, 2002, entitled "SYSTEM FOR FABRICATING LIQUID CRYSTAL DISPLAY AND METHOD OF FABRICATING LIQUID CRYSTAL DISPLAY USING THE SAME" , as if fully set forth herein.

This application claims the benefit of Korean Patent Application No. 2002-9124, filed on Feb. 20, 2002, which is hereby incorporated by reference for all purposes as if fully set forth herein.

BACKGROUND OF THE INVENTION

1. Field of the Invention

The present invention relates to a liquid crystal dispensing apparatus, and more particularly, to a liquid crystal dispensing apparatus having a needle sheet formed as a unitary piece, wherein liquid crystal material is prevented from remaining in the needle sheet and a cleaning process may be simplified.

2. Discussion of the Background Art

As portable electric devices such as mobile phones, personal digital assistants (PDA), notebook computers, etc., continue to be developed, small, light, and power-efficient flat panel display devices such as liquid crystal displays (LCD), plasma display panels (PDP), field emission displays (FED), vacuum fluorescent displays (VFD), etc., have become the subject of intense research. Due to their ability to be mass-produced, ease in driving, and superior image qualities, LCDs are of particular interest.

LCDs display information on a screen using refractive anisotropic properties of liquid crystal material. Referring to FIG. 1, an LCD 1 typically includes a lower substrate (i.e., a driving device array substrate) 5 connected to an upper substrate (i.e., a color filter substrate) 3 via sealant 9. A layer of liquid crystal material 7 separates the lower and upper substrates 5 and 3. A plurality of pixels (not shown) is formed on the lower substrate 5 and driving devices such as thin film transistors (TFTs) are formed on each of the pixels. A color filter layer is formed on the upper substrate 3 allowing the LCD to express color. Further, pixel electrodes and a common electrode are also formed on the lower and upper substrates 5 and 3, respectively. An alignment layer is formed on both the lower and upper substrates 5 and 3 to uniformly align molecules within the layer of liquid crystal material 7. The molecules within the layer of liquid crystal material may be selectively oriented by the driving devices. Accordingly, as the orientation of the molecules within the liquid crystal material is manipulated, the amount of light transmitted through portions of the LCD may be selectively controlled to convey information.

Fabrication processes for LCD devices may be roughly divided into a driving device array fabrication process, where driving devices are formed on the lower substrate 5, a color filter fabrication process, where the color filter is formed on the upper substrate 3, and a cell fabrication process. These fabrication processes will now be described with reference to FIG. 2.

Referring to FIG. 2, in the driving device array substrate fabrication process (S101), a plurality pixel areas are formed at crossings of a plurality of gate lines and data lines formed on the lower substrate 5 and thin film transistors arranged in each pixel area are connected to gate lines and corresponding ones of data lines. Also, pixel electrodes are connected to each of the thin film transistors to drive the layer of liquid crystal material. Accordingly, the layer of liquid crystal material may be driven in accordance with a signal applied to the thin film transistor.

In the color filter fabrication process (S104), red (R), green (G), and blue (B) color filter layers for producing color and a common electrode are formed on the upper substrate 3.

The alignment layer is formed on both the lower and upper substrates 5 and 3, respectively. After being formed on the substrates, the alignment layer is rubbed to induce molecules within the layer of liquid crystal material to inherit a predetermined pretilt angle and alignment direction between the lower and upper substrates 5 and 3 (S102 and S105). Subsequently, spacers are dispensed over the lower substrate 5 to maintain a uniform cell gap between the upper and lower substrates (S103). The sealant is applied to an outer portion of the upper substrate 3 (S106) and the lower substrate 5 is pressed and attached to the upper substrate 3 (S107).

The lower and upper substrates 5 and 3 are formed from glass substrates having an area larger in size than any individual panel areas. Accordingly, a plurality of corresponding panel areas are formed where driving devices and color filter layers are arranged within the attached glass substrates. Thus, in fabricating individual liquid crystal display panels, the attached glass substrates are cut into individual panels (S108). Subsequently, liquid crystal material is injected through a liquid crystal injection opening into the cell gap formed between the two substrates of each individual liquid crystal display panel (S109). After the liquid crystal material is injected, the liquid crystal injection opening is sealed (S109) and each individual liquid crystal display panel is inspected (S110).

To inject the liquid crystal material through the liquid crystal injection opening, a pressure difference between the exterior and the interior of the liquid crystal display panel is induced. FIG. 3 illustrates a device used to inject liquid crystal material into cell gaps of liquid crystal display panels.

Referring to FIG. 3, liquid crystal material 14 is provided in a container 12 arranged within a vacuum chamber 10 that is connected to a vacuum pump (not shown) capable of creating and maintaining a vacuum within the vacuum chamber. A liquid crystal display panel moving device (not shown) is installed within the vacuum chamber 10 and moves separated liquid crystal display panels down from an upper portion of the container 12 toward the surface of the liquid crystal material 14. In what is known as a liquid crystal injection method, the liquid crystal injection opening 16 of each liquid crystal display panel is arranged to contact the liquid crystal material. Subsequently, nitrogen gas (N2) is pumped into the vacuum chamber to increase the pressure therein from the initial vacuum pressure. As the pressure within the vacuum chamber 10 increases, the liquid crystal material 14 contacting the liquid crystal injection opening 16 is extruded (i.e., injected) into the cell gap of the liquid crystal display panel due to the pressure difference between the interior of the liquid crystal display panel and the interior of the vacuum chamber containing the pumped nitrogen gas. After the cell gap is completely filled with liquid crystal material 14, the injection opening 16 is sealed using a sealant.

Injecting liquid crystal material according to the process described above is disadvantageous, however, at least for the following reasons.

First, the amount of time required to completely inject liquid crystal material 14 into the liquid crystal display panel 1 can be excessively long. For example, the cell gap between the driving device array and the color filter substrates is very narrow (e.g., on the order of a few micrometers) and, therefore, only a very small amount of liquid crystal material can be injected into the liquid crystal display panel at any time. Accordingly, injecting liquid crystal material into a typical 15-inch liquid crystal display panel using the injection process described above may take up to about eight hours. Thus, the time required to fabricate LCDs is unduly increased with the use of the liquid crystal injection process.

Second, the amount of liquid crystal material required by the liquid crystal injection method described above is exceedingly large. While only a small amount of liquid crystal is removed from the container 12, a large amount of liquid crystal may become exposed to the atmosphere or to the nitrogen gas. Accordingly, a large amount of liquid crystal material reacts with, and can be contaminated by, nitrogen or other gases within the atmosphere. As a result, the cost of fabricating LCDs increases because liquid crystal material not injected into the liquid crystal display panel must be discarded after the injection process.

SUMMARY OF THE INVENTION

Accordingly, the present invention is directed to a liquid crystal dispensing apparatus having an integrated needle sheet that substantially obviates one or more of the problems due to limitations and disadvantages of the related art.

An advantage of the present invention provides a liquid crystal dispensing apparatus for dispensing liquid crystal material directly onto a glass substrate including at least one liquid crystal panel.

Another advantage of the present invention provides a liquid crystal dispensing apparatus capable of preventing the contamination of LCD devices, wherein the cleaning of a needle sheet may be simplified.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve the advantages of the present invention, as embodied and broadly described, a liquid crystal dispensing apparatus may, for example, include a liquid crystal container for holding liquid crystal material to be dispensed, a gas input line, a case for receiving the liquid crystal container, a needle capable of being inserted into the liquid crystal container, wherein the needle is movable in up-and-down directions, a spring arranged at one end of the needle, a needle sheet arranged at a lower portion of the liquid crystal container to couple the liquid crystal container to the case, wherein a portion of the needle sheet contacts the needle and includes discharging hole that is opened/closed due to the up-and-down movement of the needle, and a nozzle coupled to a lower portion of the liquid crystal container via the needle sheet, wherein the nozzle includes a discharge opening for dispensing liquid crystal held in the liquid crystal container onto a substrate that includes at least one panel.

In one aspect of the present invention, the needle sheet may include a coupling portion for coupling the liquid crystal container to the case and the liquid crystal container to the nozzle.

In another aspect of the present invention, a needle contacting portion may be integrally formed with the coupling portion and contacting the needle.

In yet another aspect of the present invention, the needle contacting portion and end portion of the needle contacting the needle contacting portion may be formed of hard metal.

In still another aspect of the present invention, the needle sheet may be formed as a unitary piece such fine gaps within the needle sheet are removed. Accordingly, liquid crystal material does not remain within the needle sheet and contaminated liquid crystal material may be prevented from being dispensed onto a substrate. Further, contamination of LCD devices may be prevented while allowing the needle sheet to be easily cleaned.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

In order to solve the problems of the aforementioned liquid crystal material injection methods, liquid crystal dispensing methods have been proposed. The liquid crystal dispensing method forms a liquid crystal layer by dispensing liquid crystal material directly onto a substrate and uniformly distributing the dispensed liquid crystal material over the entire surface of the substrate by pressing the substrate. The aforementioned liquid crystal dispensing method enables the liquid crystal material to be arranged on the substrate within a short period of time so that the process of forming a liquid crystal layer in large LCD panels may be performed quickly. Since a predetermined amount of liquid crystal material is dispensed on the substrate, consumption of liquid crystal material is minimized. Accordingly, costs of manufacturing LCDs may be reduced.

Figure 4:
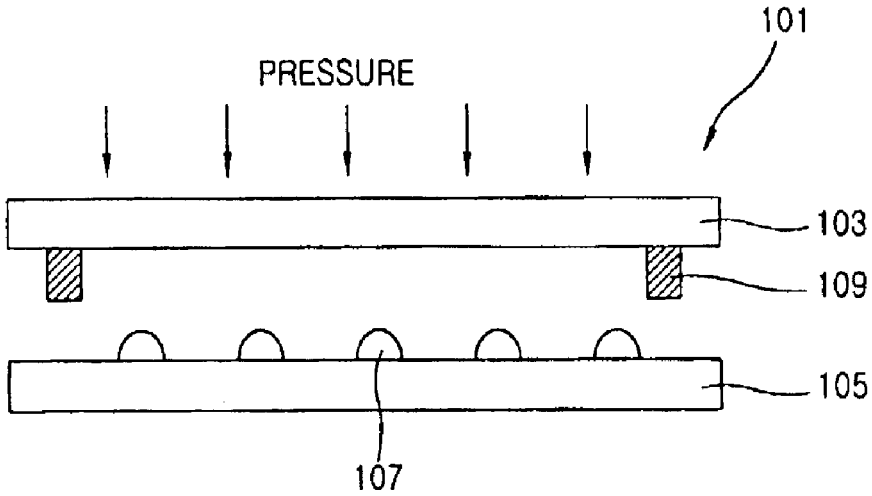
FIG. 4 illustrates the fabrication of an LCD using a liquid crystal dispensing method according to one aspect of the present invention.

FIG. 4 illustrates the fabrication of an LCD using a liquid crystal dispensing method according to one aspect of the present invention.

Referring to FIG. 4, the liquid crystal material may be dispensed prior to bonding a lower substrate 105, on which driving devices may be formed with an upper substrate 103, on which a color filter may be formed. Accordingly, liquid crystal material 107 may be dispensed on the lower substrate 105, for example, in the form of a droplet. Alternatively, the liquid crystal material 107 may be dispensed on the upper substrate 103. Regardless of which substrate supports the liquid crystal material 107, during the bonding process, the substrate supporting liquid crystal material 107 should be arranged such that it is located under the other substrate, wherein the liquid crystal material 107 is arranged between the two substrates.

Sealant 109 may be dispensed along edges on the upper substrate 103 to bond the upper substrate 103 to the lower substrate 105 when they are pressed together. As the upper and lower substrates 103 and 105, respectively, are pressed, the liquid crystal material 107 becomes spread so that a liquid crystal layer having a uniform thickness may be formed between the upper and lower substrate 103 and 105. Subsequently, the bonded substrates may be separated into individual LCD panels. Accordingly, the liquid crystal dispensing method may dispense liquid crystal material 107 onto the lower substrate 105 prior to final assembly of the liquid crystal display panel 101.

Figure 1:
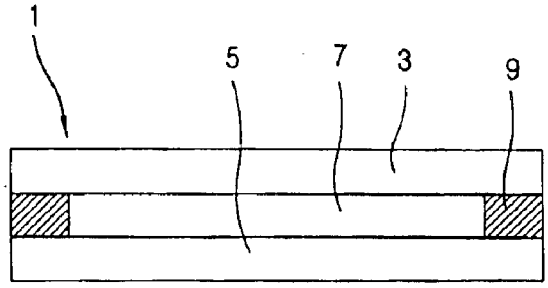
FIG. 1 RELATED ART
FIG. 1 illustrates a cross-sectional view of a related art liquid crystal display (LCD) device.
Figure 2:
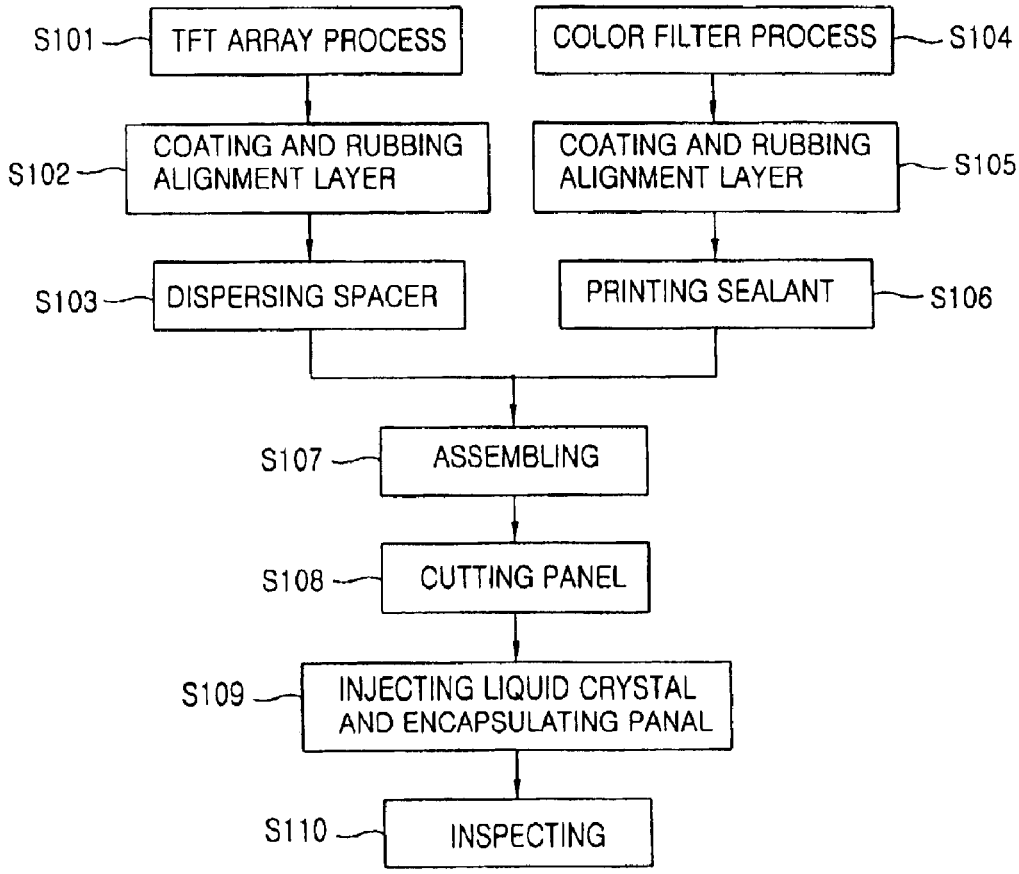
FIG. 2 RELATED ART
FIG. 2 illustrates a flow chart of a related art LCD fabrication method.
Figure 3:
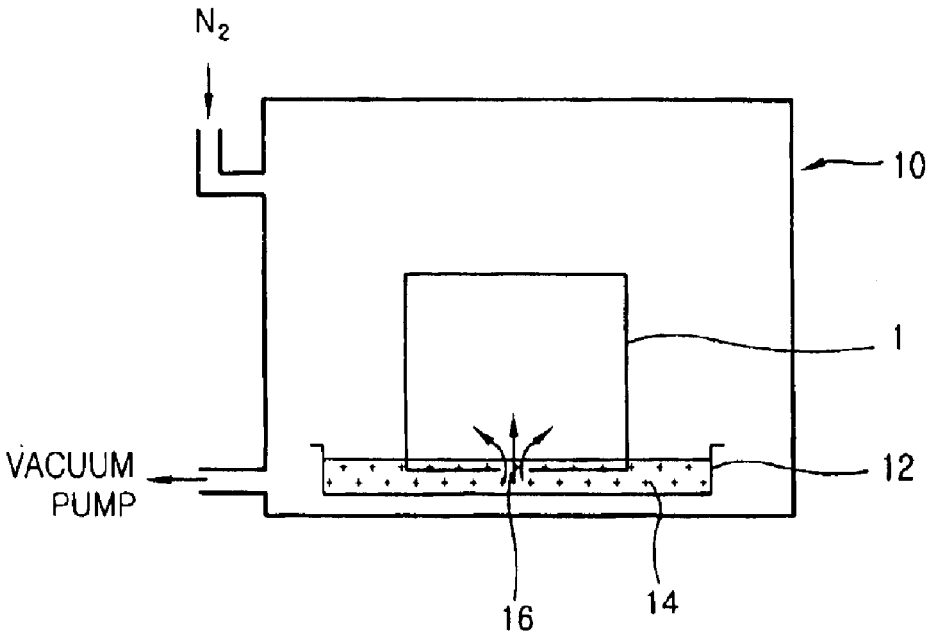
FIG. 3 RELATED ART
FIG. 3 illustrates injection of liquid crystal material in a related art LCD device.

As is evident, the liquid crystal injection method illustrated in FIGS. 1–3 differs from the liquid crystal dispensing method illustrated in FIG. 4. For example, in injecting liquid crystal material, a glass substrate must be divided into individual panels to inject the liquid crystal while, in dispensing liquid crystal material, liquid crystal material is dispensed to individual panels from a glass substrate already processed and divided.

Figure 5:
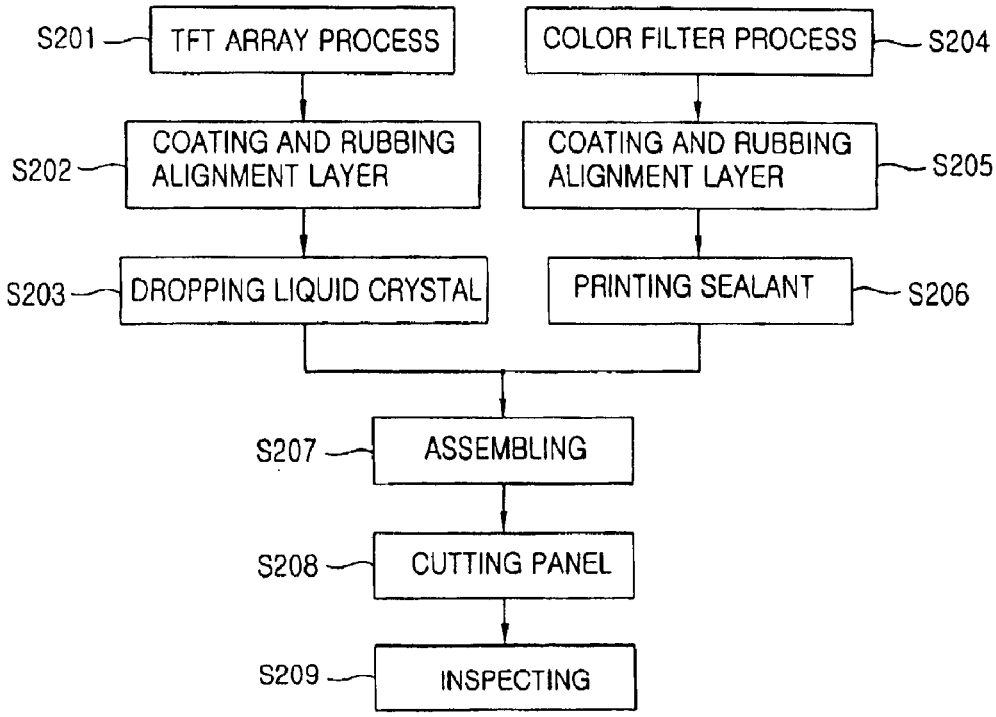
FIG. 5 illustrates a flow chart of a method for fabricating LCD device using a liquid crystal dispensing method.

FIG. 5 illustrates a flow chart of a method for fabricating LCD device using a liquid crystal dispensing method.

Referring to FIG. 5, driving devices (e.g., TFTs) and a color filter layer are formed on the lower and upper substrates, respectively, in respective TFT array fabrication and color filter fabrication processes (S201 and S204), similar to the driving device array substrate fabrication and color filter fabrication processes shown in FIG. 2. The lower and upper substrates may be provided as glass substrates including a plurality of individual panel areas. By incorporating the liquid crystal dispensing method in the fabrication of LCDs, glass substrates having an area up to 1000×1200 $mm^2$ or more (an area much larger than glass substrates fabricated using liquid crystal injection methods) may be efficiently processed into individual panels.

An alignment layer may be formed on the lower and upper substrates. Subsequently, the alignment layers may be rubbed (S202 and S205) and liquid crystal material may be dispensed onto liquid crystal display panel areas within the lower substrate (S203). Also, sealant may be applied to outer portions of corresponding liquid crystal display panel areas within the upper substrate (S206).

Next, the upper and lower substrates may be disposed opposite each other and pressed and attached together via the sealant. When the two substrates are pressed, the dispensed liquid crystal material spreads uniformly over the entire surface of the panels (S207). By the aforementioned liquid crystal dispensing method, a plurality of liquid crystal display panels may be simultaneously formed within the attached upper and lower glass substrates. Next, the attached glass substrates may be cut (S208) to separate the plurality of individual LCD panels. The individual LCD panels may then be inspected (S209).

Manufacturing LCDs according to the aforementioned liquid crystal dispensing method is advantageous over the liquid crystal injection method illustrated, for example, in FIG. 2 in that layers of liquid crystal material may be rapidly formed between the upper and lower substrates. The liquid crystal injection method shown in FIG. 2 requires the injection opening to be sealed by the sealing material after injection is complete. However, in fabricating LCDs via the liquid crystal dispensing method, no injection openings exist that need to be sealed. In fabricating LCDs via the liquid crystal injection method, panels contact liquid crystal material within the container during injection. As a result, outer surfaces of the LCD panels become contaminated and a cleaning process is required. However, in fabricating LCDs via the liquid crystal dispensing method, liquid crystal material may be dispensed directly onto the substrate. As a result, outer surfaces of substrates are not contaminated with liquid crystal material and extra cleaning processes are not required. Accordingly, methods of fabricating LCDs that incorporate liquid crystal dispensing methods are less complex, more efficient, and have a greater yield than methods of fabricating LCDs that incorporate liquid crystal injection methods.

In fabricating LCDs via the liquid crystal dispensing method, the layer of liquid crystal material must be formed to a predetermined thickness, directly proportional to the size of the cell gap in the LCD panel. Accordingly, positions of the liquid crystal droplets and the amount of liquid crystal material they contain must be precisely controlled. Therefore, an apparatus for dispensing liquid crystal material in precisely arranged droplets each containing a precise amount of liquid crystal material is provided in accordance with the principles of the present invention.

Figure 6:
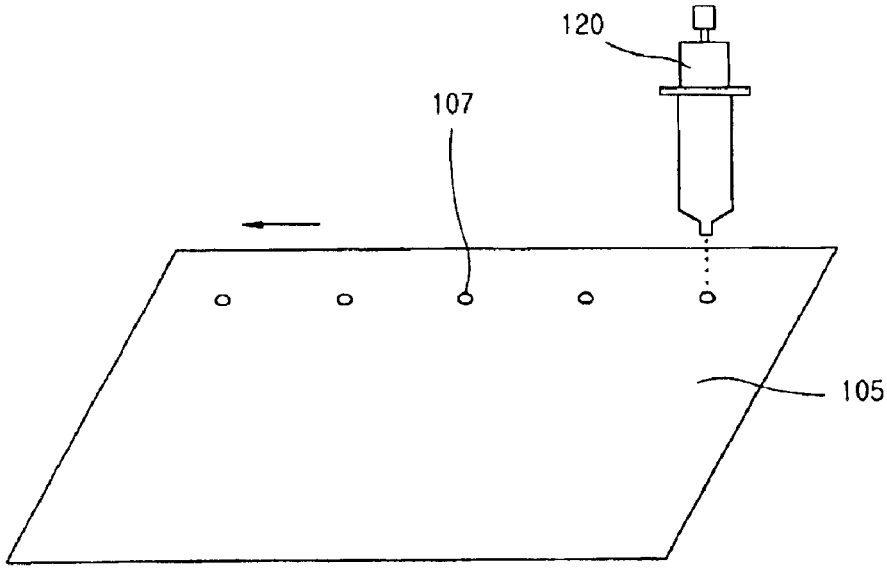
FIG. 6 illustrates the fabrication of an LCD using a liquid crystal dispensing method according to another aspect of the present invention.

FIG. 6 illustrates the fabrication of an LCD using a liquid crystal dispensing method according to one aspect of the present invention.

Referring to FIG. 6, liquid crystal material 107 may be dispensed onto the lower substrate 105 (including a plurality of panel areas) using a liquid crystal dispensing apparatus 120. In accordance with the principles of the present invention, the liquid crystal dispensing apparatus 120 may be arranged over the substrate 105 and, although not shown in FIG. 6, contains liquid crystal material to be dispensed.

Generally, the liquid crystal material 107 is dispensed onto the substrate in the form of a droplet. In a first aspect of the present invention, the substrate 105 may move in x- and y-directions at a predetermined speed while the liquid crystal dispensing apparatus 120 remains in a fixed position and dispenses liquid crystal material at predetermined times. As a result, droplets of liquid crystal material may be arranged on the substrate 105 and spaced apart from each other along x- and y-directions at predetermined intervals. In a second aspect of the present invention, the substrate 105 may remain in a fixed position while the liquid crystal dispensing apparatus 120, moving in x- and y-directions, dispenses liquid crystal material onto the substrate. Similar to the effect of the preceding aspect, droplets of liquid crystal material may be arranged on the substrate 105 and spaced apart from each other along x- and y-directions at predetermined intervals. By the second aspect, liquid crystal material may, however, by dispensed non-uniformly onto the substrate 105 due to the movement of the liquid crystal dispensing apparatus 120. Accordingly, the locations of, and amount of liquid crystal material contained in, droplets arranged on the substrate 105 may deviate from the predetermined locations and amounts. Therefore, dispensing liquid crystal material according to the first aspect is generally preferred over the second aspect.

Figure 7A:
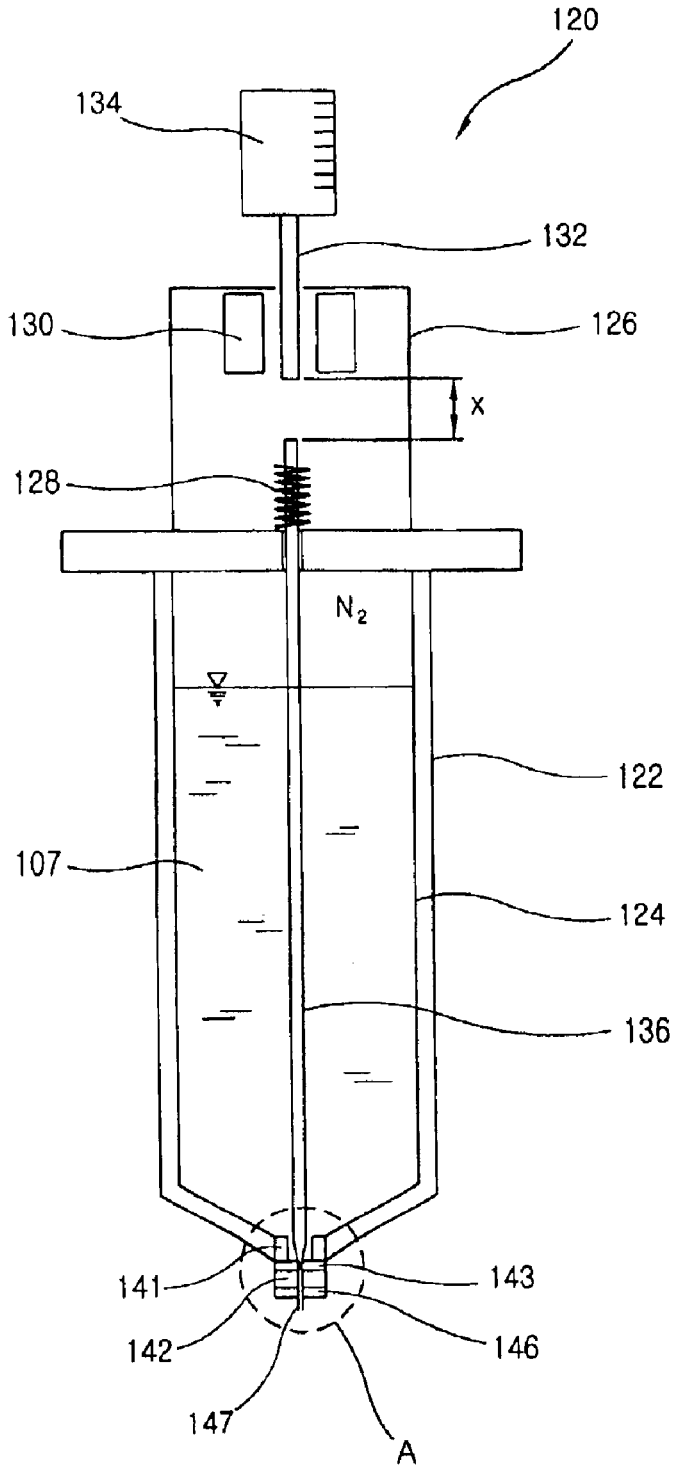
FIGS. 7A and 7B illustrate a liquid crystal dispensing apparatus according to one aspect of the present invention.
Figure 7B:
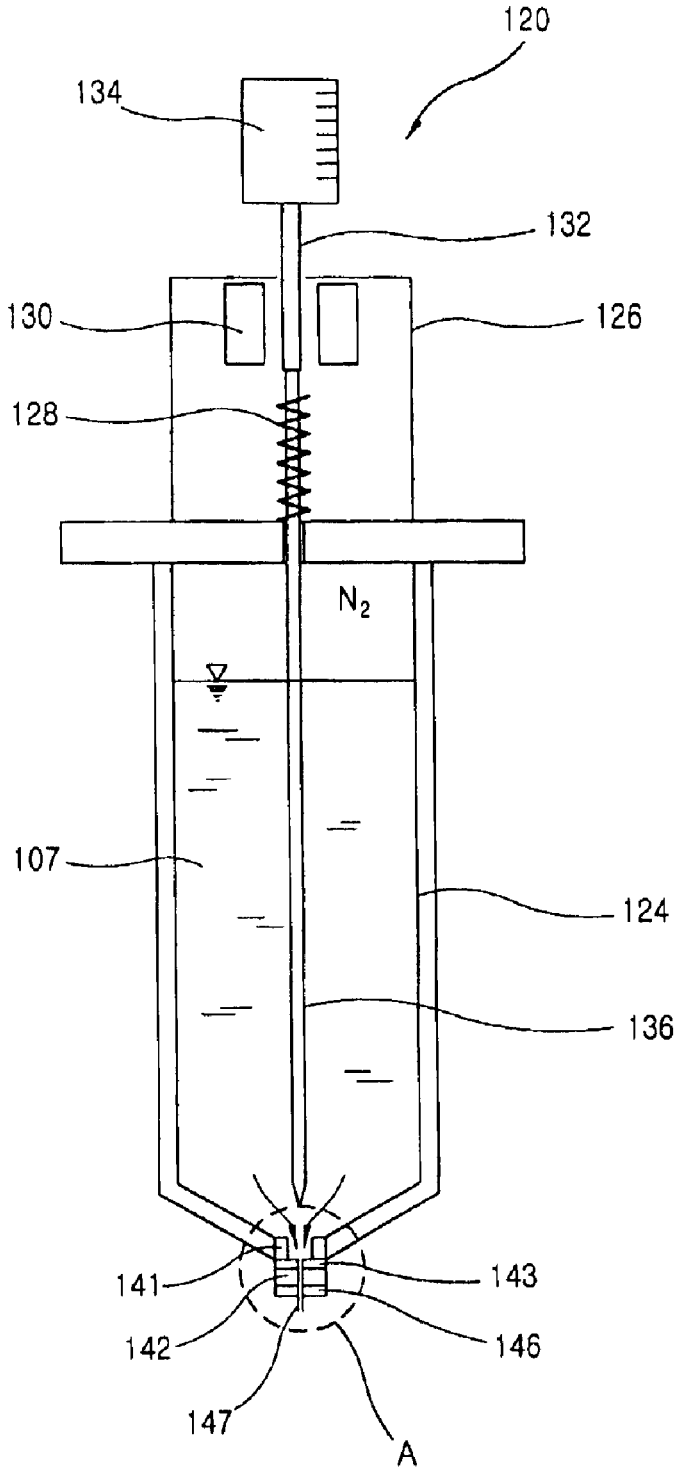

FIGS. 7A and 7B illustrate a liquid crystal dispensing apparatus according to one aspect of the present invention. FIG. 7A illustrates the liquid crystal dispensing apparatus when liquid crystal material is not dispensed. FIG. 7B illustrates the liquid crystal dispensing apparatus when liquid crystal material is dispensed.

Referring to FIGS. 7A and 7B, the liquid crystal dispensing apparatus may, for example, include a cylindrically shaped liquid crystal container 124. In one aspect of the present invention, the liquid crystal container 124 may be made of a material a having a high moldability, high plasticity, and that is substantially non-reactive with liquid crystal material (e.g., polyethylene, etc.). Materials such as polyethylene, however, have a low strength and may therefore become easily deformed by applied stresses. When the liquid crystal container 124 is deformed, liquid crystal material cannot be dispensed precisely onto the substrate. Accordingly, the container 124 may be inserted within case 122. In one aspect of the present invention, case 122 may be formed of a material having a high strength (e.g., stainless steel, etc.). Although not shown, a gas supply tube connected to an exterior gas supply unit may be arranged at an upper portion of the liquid crystal container 124. Gas such as nitrogen ($N_2$) may be provided by the exterior gas supply unit, transported through the gas supply tube, and arranged within portions of the liquid crystal container 124 not occupied by liquid crystal material 107. Accordingly, the gas may press on the liquid crystal material 107.

A needle sheet 140 may be provided at a lower portion of the case 122. The needle sheet 140 may couple the case 122 and the liquid crystal container 124 together. Although not shown, a protrusion may extend from a lower portion of the liquid crystal container 124 and an opening may be formed within the case 122 to receive the protrusion. Accordingly, the protrusion of the liquid crystal container 124 may be inserted into the opening of the case 122 and coupled to the needle sheet 140. Additionally, a nozzle 145 for dispensing predetermined amounts of liquid crystal material 107 within the liquid crystal container 124 may be coupled to the needle sheet 140.

Figure 8:
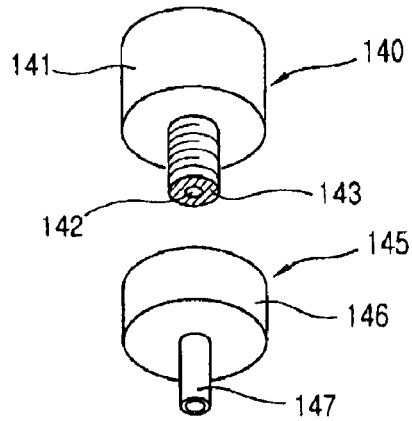
FIG. 8 illustrates an exploded perspective view of region 'A' shown in FIGS. 7A and 7B.

FIG. 8 illustrates an exploded perspective view of region 'A' shown in FIGS. 7A and 7B.

Referring to FIG. 8, the needle sheet 140 may, for example, include a coupling portion 141 and a needle contacting portion 143 formed together as a unitary piece. In one aspect of the present invention, the coupling portion 141 may comprise a nut portion and a bolt portion. The protrusion (not shown) of the liquid crystal container 124 may be inserted into and coupled with the nut portion of the coupling portion 141. The bolt portion of the coupling portion 141 may be inserted into and coupled with a nut portion of the nozzle 145. A discharge hole 142, through which the liquid crystal material 107 within the liquid crystal container 124 may be dispensed onto the substrate, may be formed within the needle contacting portion 143 of the needle sheet. In one aspect of the present invention, the discharge hole 142 functions enable liquid crystal material 107 to be transported outside the liquid crystal dispensing apparatus 120. Accordingly, the discharge hole 142 may be opened/closed by a needle 136 such that liquid crystal material 107 within the liquid crystal container 124 may be allowed into/prevented from entering the discharge hole 142. Liquid crystal material 107 allowed into the discharge hole 142 may then be dispensed onto the substrate.

According to the principles of the present invention, the nozzle 145 may comprise a supporting portion 146 that is coupled to the coupling portion 141 of the needle sheet 140 and a discharge opening 147, through which liquid crystal material 107 within the liquid crystal container 124 may be dispensed onto the substrate. The bolt portion of the coupling portion 141 may be arranged within the supporting portion 146. In one aspect of the present invention, a discharge tube (not shown), through which liquid crystal material may be dispensed onto the substrate, may be formed parallel to a portion of the discharge hole 142 arranged proximate the supporting portion 146 such that the discharge opening 147 may extend from the discharge tube. In one aspect of the present invention, liquid crystal material 107 may enter into the discharge hole 142 and be dispensed onto the substrate via the discharge opening 147.

According to the principles of the present invention, the needle 136 may be inserted into the liquid crystal container 124 such that a first end of the needle 136 contacts the needle contacting portion 143 of the needle sheet 140. In one aspect of the present invention, the first end of the needle 136 may be provided with a conical shape having dimensions substantially conformal to the perimeter of the discharge hole 142. The first end of the needle may be inserted into the discharge hole 142 of the needle contacting portion 143 and close the discharge hole 142.

According to the principles of the present invention, a second end of the needle 136 may be arranged near an upper case 126 of the liquid crystal dispensing apparatus 120 where a spring 128 and magnetic bar 132 are provided. The magnetic bar 132 maybe formed of a ferromagnetic or soft magnetic material. A gap controlling unit 134 may be connected to the needle 136 above the magnetic bar 132. A solenoid coil 130 having, for example, a cylindrical shape may be arranged to surround at least a portion of the magnetic bar 132. The solenoid coil 130 may be connected to, and receive electric power from, an electric power supply unit (not shown). Upon receipt of the electric power, the solenoid coil 130 may exert a magnetic force on the magnetic bar 132.

In one aspect of the present invention, the needle 136 and the magnetic bar 132 may be spaced apart from each other by a predetermined distance, x. When the electric power is applied to the solenoid coil 130, a magnetic force is exerted on the magnetic bar 132 to induce the needle 136 to contact the magnetic bar 132. When the electric power is not applied to the solenoid coil 130, the elastic force of the spring 128 pushes the needle 136 to its original position. By the movement of the needle 136 toward and away from the needle sheet 143, the discharging hole 142 formed in the needle sheet 140 may be opened or closed. As the first end of the needle 136 and the needle sheet 140 may contact each other repeatedly, depending on the presence of electric power applied to the solenoid coil 130, the first end of the needle 136 and the needle sheet 140 may become damaged. Accordingly, the first end of the needle 136 and the needle contacting portion 143 of the needle sheet 140 may be formed of a material that substantially resist deformation (e.g., a hard metal).

Referring to FIG. 7B, when electric power is applied to the solenoid coil 130, the needle 136 is away from the needle sheet and the discharge hole is opened. Accordingly, nitrogen gas supplied to the liquid crystal container 124 presses on the liquid crystal material 107 and causes it to be dispensed via the nozzle 145. The amount of liquid crystal material 107 dispensed depends upon the time during which the discharging hole 142 is open and the pressure of the nitrogen gas within the liquid crystal container. The time during which the discharging hole 142 is opened depends upon the distance, x, between the needle 136 and the magnetic bar 132, the magnetic force exerted on the magnetic bar 132 by the solenoid coil, and the intrinsic elastic force of the spring 128. The magnetic force exerted on the magnetic bar 132 is proportional to the winding number of the solenoid coil 130 or the magnitude of the electric power applied to the solenoid coil 130. The distance, x, between the needle 136 and the magnetic bar 132 may be controlled by the gap controlling unit 134.

In one aspect of the present invention, the solenoid coil 130 may be arranged around the needle 136 instead of around the magnetic bar 132. Accordingly, the needle 136 may be formed of a magnetic material and be magnetized when electric power is applied to the solenoid coil 130. Additionally, the magnetic bar 132 may be fixed in a particular position. Therefore, the needle 136 may move upward and downward to selectively contact the magnetic bar 132.

As described above, the needle sheet 140, which the needle 136 contacts to control the dispensing of the liquid crystal material 107, may be provided as a unitary piece. Accordingly, the coupling portion 141, coupling the liquid crystal container 124 to the case 122 and the nozzle 145, and the needle contacting portion 143 that contacts the needle 136 are formed as a unitary piece. The following advantages may be realized when using the needle sheet of the present invention.

Figure 9:
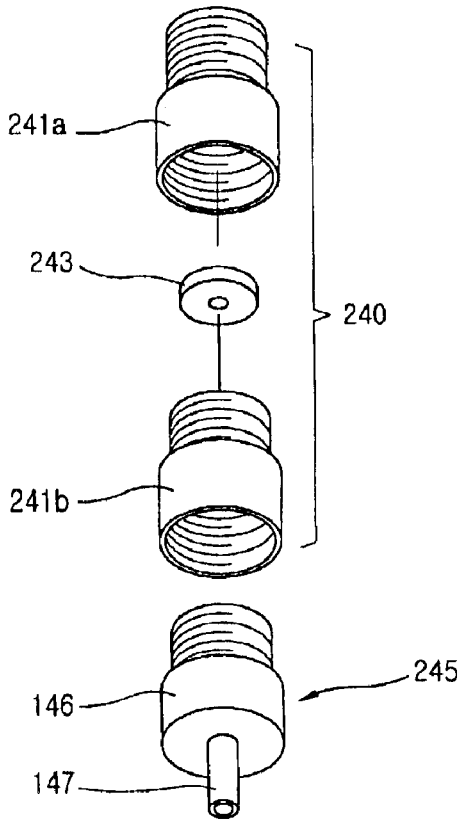
FIG. 9 illustrates a needle sheet in a related art liquid crystal dispensing apparatus.

FIG. 9 illustrates a needle sheet in a related art liquid crystal dispensing apparatus.

Referring to FIG. 9, a related art needle sheet 240 used in a liquid crystal dispensing apparatus comprises a first coupling portion 241*a*, a second coupling portion 241*b*, and a needle contacting member 243 arranged between the first and second coupling portions 241*a* and 241*b*. The first coupling portion 241*a* couples the liquid crystal container 124 to the case 122. The second coupling portion 242*b* couples the liquid crystal container 124 to the nozzle 145. The needle contacting member 243 includes a discharge hole that may be opened/closed by needle 136 thereby allowing liquid crystal material to be selectively dispensed. The related art needle sheet 240 is provided as a plurality of separate components assembled together. In forming the related art needle sheet 240, the separate components are assembled in a predetermined order as they are mounted onto the liquid crystal dispensing apparatus. As the separate components of the needle sheet 240 are assembled, however, fine gaps between the first coupling portion 241*a*, the second coupling portion 241*b*, and the needle contacting portion 243 may be formed. For example, fine gaps may be formed between the first coupling portion 241*a* and the needle contacting portion 243 and between the second coupling portion 241*b* and the needle contacting portion 243. As a result, liquid crystal material 107 is forced into, and remains within, the fine gaps.

Liquid crystal material remaining within the fine gaps increases ionic impurities and contaminates the liquid crystal material 107 forced out of the liquid crystal container 124. Subsequently, the contaminated liquid crystal material is leaked to the nozzle 245 and dispensed onto the substrate. Therefore, the layer of liquid crystal material is contaminated and a specific resistance of the liquid crystal material increases to lower a voltage maintenance factor of the LCD device. Accordingly, LCD devices formed with a contaminated layer of liquid crystal material have a degraded quality.

In order to prevent the liquid crystal material dispensed from becoming contaminated, the needle sheet 240 must be cleaned after liquid crystal material is dispensed a predetermined number of times. Liquid crystal material may generally be removed by soaking the needle sheet 240 in a cleaning chamber filled with acetone and isopropyl alcohol and liquid crystal material is thereby removed. However, the acetone and isopropyl alcohol does not easily infiltrate the fine gaps between the first coupling portion 241*a*, the second coupling portion 241*b*, and the needle contacting portion 243. Therefore, it becomes extremely difficult to completely remove the liquid crystal material remaining within the fine gaps. In order to completely remove the remaining liquid crystal material, the first and second coupling portions 241*a* and 241*b* and the needle contacting portion 243 must be disassembled before they are cleaned. However, disassembling the needle sheet 240 is troublesome and time consuming to disassemble the needle sheet 240 into its constituent components.

According to the principles of the present invention, the needle sheet 140 is formed as a unitary piece such that fine gaps do not exist in the needle sheet 140. Therefore, liquid crystal material does not remain in the needle sheet 140 to contaminate liquid crystal material dispensed onto the substrate. Additionally, when cleaning, there is no need for disassembling the needle sheet 140 thereby simplifying the cleaning process.

According to the principles of the present invention, the needle sheet 140 of the liquid crystal dispensing apparatus 120 may be provided as a unitary piece coupled to the liquid crystal container 124 and the nozzle 145. Liquid crystal material does not remain on the needle sheet 140 after liquid crystal material is dispensed such that LCD devices do not include contaminated layers of liquid crystal material. Also, since the needle sheet is formed as a unitary piece, a step of cleaning may be simplified.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal dispensing apparatus comprising:

a liquid crystal container for containing liquid crystal material and gas wherein the gas is arranged within a portion of the liquid crystal container not occupy by the liquid crystal;

a case receiving the liquid crystal container;

a needle inserted into the liquid crystal container, the needle having a first end and a second end and for movement along an axis of the liquid crystal container;

a spring arranged on the first end of the needle;

a needle sheet arranged at a lower portion of the liquid crystal container for coupling the liquid crystal container to the case, the needle sheet comprising a discharging hole, wherein the needle contacts a portion of the needle sheet surrounding the discharging hole; and a nozzle coupled to a lower portion of the liquid crystal container by the needle sheet, the nozzle including a discharge opening through which liquid crystal material in the liquid crystal container is dispensable onto a substrate.

2. The liquid crystal dispensing apparatus of claim 1, wherein the discharging hole is opened and closed according to the movement of the needle.

3. The liquid crystal dispensing apparatus of claim 1, wherein the substrate comprises at least one liquid crystal display panel.

4. The liquid crystal dispensing apparatus of claim 1, further comprising:

a magnetic bar arranged proximate the first end of the needle; and a solenoid coil arranged proximate the magnetic bar, the solenoid coil for exerting a magnetic force to the magnetic bar and for moving the needle toward the magnetic bar upon the application of an electric power.

5. The liquid crystal dispensing apparatus of claim 1, wherein the needle sheet comprises:

a coupling portion for coupling the liquid crystal container to the case and the liquid crystal to the nozzle; and a needle contacting portion formed integrally with the coupling portion for contacting the needle.

6. The liquid crystal dispensing apparatus of claim 3, wherein the needle contacting portion is made of a hard metal.

7. The liquid crystal dispensing apparatus of claim 3, wherein the needle contacting portion is made of stainless steel.

8. The liquid crystal dispensing apparatus of claim 1, wherein the second end of the needle contacts the needle sheet and is made of a hard metal.

* * * * *